US006698125B2

(12) United States Patent
Baker

(10) Patent No.: US 6,698,125 B2
(45) Date of Patent: Mar. 2, 2004

(54) FIREARM SAFETY MECHANISM WITH TRIGGER FACILITATED RETRACTING TRANSFER BAR

(75) Inventor: Robert E. Baker, Bedford, WY (US)

(73) Assignee: Freedom Arms, Freedom, WY (US)

( * ) Notice: Subject to any disclaimer, the term of this patent is extended or adjusted under 35 U.S.C. 154(b) by 0 days.

(21) Appl. No.: 10/042,641

(22) Filed: Jan. 8, 2002

(65) Prior Publication Data

US 2003/0126782 A1 Jul. 10, 2003

(51) Int. Cl.[7] ..... F41A 17/00
(52) U.S. Cl. ..... 42/66; 42/70.08
(58) Field of Search ..... 42/66, 70.08

(56) References Cited

U.S. PATENT DOCUMENTS

| | | | | | |
|---|---|---|---|---|---|
| 566,393 | A | | 8/1896 | Fyrberg | |
| 644,660 | A | * | 3/1900 | Caldwell | 42/70.08 |
| 649,809 | A | * | 5/1900 | Caldwell | 42/66 |
| 658,314 | A | * | 9/1900 | Bye | 42/66 |
| 911,362 | A | * | 2/1909 | Aubrey | 42/70.08 |
| 933,188 | A | | 9/1909 | Leggett | |
| 2,470,259 | A | | 5/1949 | Norman et al. | 42/66 |
| 3,157,958 | A | | 11/1964 | Lewis | 42/70 |
| 3,482,348 | A | | 12/1969 | Zanchi | 42/66 |
| 3,628,278 | A | | 12/1971 | Ruger | 42/62 |
| 3,777,384 | A | * | 12/1973 | Ruger et al. | 42/66 |
| 4,218,839 | A | | 8/1980 | Brouthers | 42/65 |
| 4,316,341 | A | * | 2/1982 | Landry | 42/70.08 |
| 4,383,383 | A | * | 5/1983 | Landry | 42/67 |
| 4,391,057 | A | | 7/1983 | Bornancini | 42/65 |
| 4,449,312 | A | | 5/1984 | Ruger et al. | 42/66 |
| 4,621,445 | A | | 11/1986 | Röhm | 42/66 |
| 4,680,884 | A | | 7/1987 | Smith, Jr. et al. | 42/66 |
| 4,807,380 | A | | 2/1989 | Domian | 42/65 |
| 5,285,766 | A | | 2/1994 | Milliman | 124/72 |
| 5,625,970 | A | | 5/1997 | Pantuso et al. | 42/66 |
| 5,664,356 | A | | 9/1997 | Pantuso et al. | 42/65 |
| 5,673,506 | A | | 10/1997 | Pantuso et al. | 42/67 |
| 5,724,759 | A | | 3/1998 | Kilham | 42/66 |

* cited by examiner

*Primary Examiner*—Michael J. Carone
*Assistant Examiner*—M. Thomson
(74) *Attorney, Agent, or Firm*—Kirton & McConkie; Michael F. Krieger

(57) ABSTRACT

The present invention features a firearm safety mechanism with an improved trigger pull, wherein the weight of the safety mechanism is not on the trigger when the hammer is in the "full cock" position. The advancement presented in the present invention serves to separate the trigger from the trigger bar during the period when the trigger is pulled. As a result, the weight of the safety mechanism is not borne by the trigger while the hammer is fully cocked. This is accomplished by providing means for positioning the transfer bar into the extended position free from contact with the trigger. The present invention further features means, dependent upon the trigger, for facilitating the relocation of the transfer bar from its extended position into a retracted position upon release of the trigger subsequent to discharge of the firearm.

6 Claims, 4 Drawing Sheets

FIREARM SAFETY MECHANISM WITH TRIGGER FACILITATED RETRACTING TRANSFER BAR

BACKGROUND

1. Field of the Invention

The present invention relates to firearm mechanisms employed in firearms utilizing a hammer and a firing pin, and in particular, to a firearm mechanism having an transfer bar between the hammer and the firing pin that is held in place by the trigger when the trigger is actuated, wherein the firearm mechanism is capable of facilitating the relocation of the transfer bar from an extended position to a retracted position upon the deactivation or release of the trigger.

2. Background

In an effort to improve upon the efficiency of firearms, devices have been introduced which require the presence of a transfer bar between the hammer and the firing pin to transfer the kinetic energy from the hammer to the firing pin. For example, in U.S. Pat. No. 566,393 to Fyrberg, the rearward motion of the trigger causes the release of the hammer which moves a pawl upward so as to bring the end of the pawl in the path of the hammer between the hammer face and the firing pin. These devices are typically in a retracted position until the hammer is fully cocked. If the device is not extended, the face of the hammer presents a space into which the head of the firing pin is received without effecting contact with the firing pin. When the transfer bar is in an extended position, the hammer face strikes the transfer bar and impact is carried through to the firing pin causing the cartridge to discharge. This transfer bar, or trigger bar, is mechanically elevated and is maintained in that elevated position through physical attachment to the trigger.

As a result, the weight of the trigger bar or analogous safety method must be overcome by rearward pressure on the trigger. This increased pressure on the trigger results in a reduction in accuracy. This is especially felt in light-weight firearms such as hand guns and firearms used in competition. After actuation of the trigger, the device is then maintained in the elevated position by a continued rearward pressure on the trigger as the hammer strikes the firing pin.

Release of the trigger allows the device to retract and the firing pin then extends into a recess in the hammer. This recess protects the firing pin from inadvertent impact when carrying the firearm.

Improvements to these types of safety mechanisms have been made, which allow the transfer bar weight to be borne by means other than the trigger. For example, U.S. Pat. No. 5,664,356 to Pantuso et al. describes a safety mechanism wherein the hammer has an elongated, vertically extending recess formed therein, a transfer bar traveling within that elongated recess between an extended position and a retracted position. When the transfer bar is in the extended position, the bar is interposed between the hammer and the firing pin allowing discharge of a cartridge within the chamber. When the transfer bar is in the retracted position, a portion of the recess is exposed. The exposed recess is larger than the portion of the firing pin, which protrudes from the receiver. Thus, inadvertent firing is prevented as the hammer cannot contact the firing pin. A means for positioning, preferably a transfer bar carrier pin, located on the hand assembly initially cooperates with the trigger cam and the transfer bar to elevate the bar into the extended position. The weight of the safety mechanism is, therefore, not borne by the trigger, when the hammer is in the full cock position, but by the means for positioning, thus resulting in a lighter and more accurate trigger pull. After the trigger has been fully actuated, the transfer bar carrier drops with the hand mechanism and a cam on the trigger maintains the transfer bar in the extended position. Thus, when the trigger is fully actuated, and the hammer is moving forward, the means for positioning drops away. The trigger must remain in the fully actuated position until the hammer and transfer bar impact the firing pin. If the trigger is maintained in the fully actuated position, the support of the transfer bar is shifted from the means for positioning to the trigger. Thus, the trigger must be actuated and must be maintained in the fully actuated position for the firearm to discharge. Premature release of the trigger will allow the transfer bar to drop and the firing pin will not be struck.

SUMMARY OF THE INVENTION

In accordance with the invention as embodied and broadly described herein a firearm mechanism with an improved trigger pull is provided wherein the weight of the mechanism is not on the trigger when the hammer is in the "full cock" position. The advancement presented in the present invention serves to separate the trigger from the trigger bar during the period when the trigger is pulled. As a result, the weight of the safety mechanism is not borne by the trigger while the hammer is fully cocked. This is accomplished by providing means for positioning the transfer bar into the extended position free from contact with the trigger. As the hammer is cocked, the weight of the transfer bar is borne by the means for positioning. When the trigger is fully actuated, and the hammer is moving forward, the means for positioning drops away. If the trigger is maintained in the fully actuated position, the support of the transfer bar is shifted from the means for positioning to the trigger. Thus, the trigger must be actuated and must be maintained in the fully actuated position for the firearm to discharge.

In addition, to increase the efficiency of the safety mechanism described herein, the present invention further features means for facilitating the retraction of the transfer bar from its extended position to a retracted position.

The mechanism preferably is for use with a firearm having a hammer, a cartridge receiving chamber in front of the hammer, a firing pin interposed between a face of the hammer and the cartridge receiving chamber so as to strike and fire a cartridge in the chamber upon actuation by a trigger. The mechanism comprises the following elements: a) an elongated recess formed within the face of the hammer; b) an elongated transfer bar disposed within the recess and slidably movable therein between an extended position and a retracted position, the elongated transfer bar being interposed between the hammer and the firing pin in the extended position, as well as the elongated transfer bar being juxtaposed to the firing pin in the retracted position, thereby exposing a portion of the recess capable of receiving the firing pin therein, and thereby preventing contact with the hammer; c) means, independent of the trigger, for positioning the transfer bar into the extended position and the retracted position; d) a trigger cam operated upon by the trigger, the trigger cam being capable of supporting the transfer bar to maintain the transfer bar in the extended position after the trigger has been actuated; and e) means, dependent upon the trigger, for facilitating the relocation of the transfer bar from its extended position into its retracted position upon the release of the trigger subsequent to discharge of the firearm and when the hammer is in its hammer down, safe position.

In a preferred embodiment, the means for facilitating the relocation of the transfer bar comprises an engagement assembly, wherein the engagement assembly itself comprises: a) a receiving member; and b) an engagement member capable of releasably coupling the receiving member, wherein the receiving member and the engagement member may be positioned on either of the transfer bar and the trigger cam.

The receiving member preferably comprises a protrusion extending from and integrated with one end of the transfer bar proximate the trigger, and the engagement member preferably comprises a hook extending from and extension integrated and formed with the trigger cam of the trigger.

As the action tracks through its cycle and the trigger actuated and released, the engagement assembly disengages and engages, respectively. Only in the hammer down, safe position may the engagement assembly be engaged to facilitate the retraction of the transfer bar into its retracted position. Upon drawing the hammer back, the engagement assembly disengages, but the receiving member and the engagement members maintain their alignment with one another. Once the trigger is actuated and the firearm is discharged, the engagement member is brought into position to couple the receiving member. However, the engagement assembly only facilitates the retraction of the transfer bar upon release of the trigger. As the trigger begins its release, the engagement assembly facilitates the retraction of the transfer bar by pulling the transfer bar down. The engagement assembly is dependent upon the trigger as the receiving member is formed as part of the transfer bar and the engagement member is formed as part of the trigger. As the trigger reaches its resting position, the transfer bar is completely retracted, thus enabling the firing pin to be biased outward into the recess where the action will be ready to be cycled once again.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 4, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

Reference is now made to FIGS. 1 through 4 in which a firearm action is illustrated in cross-sectional detail. Although the present invention may be utilized with other firearms having a hammer, for ease of explanation, a single action revolver is depicted in FIGS. 1 through 4. Similarly, the instant invention can not only be used in new guns, but may also be retrofit into existing actions by modifying or replacing only a few components.

Figure 1:
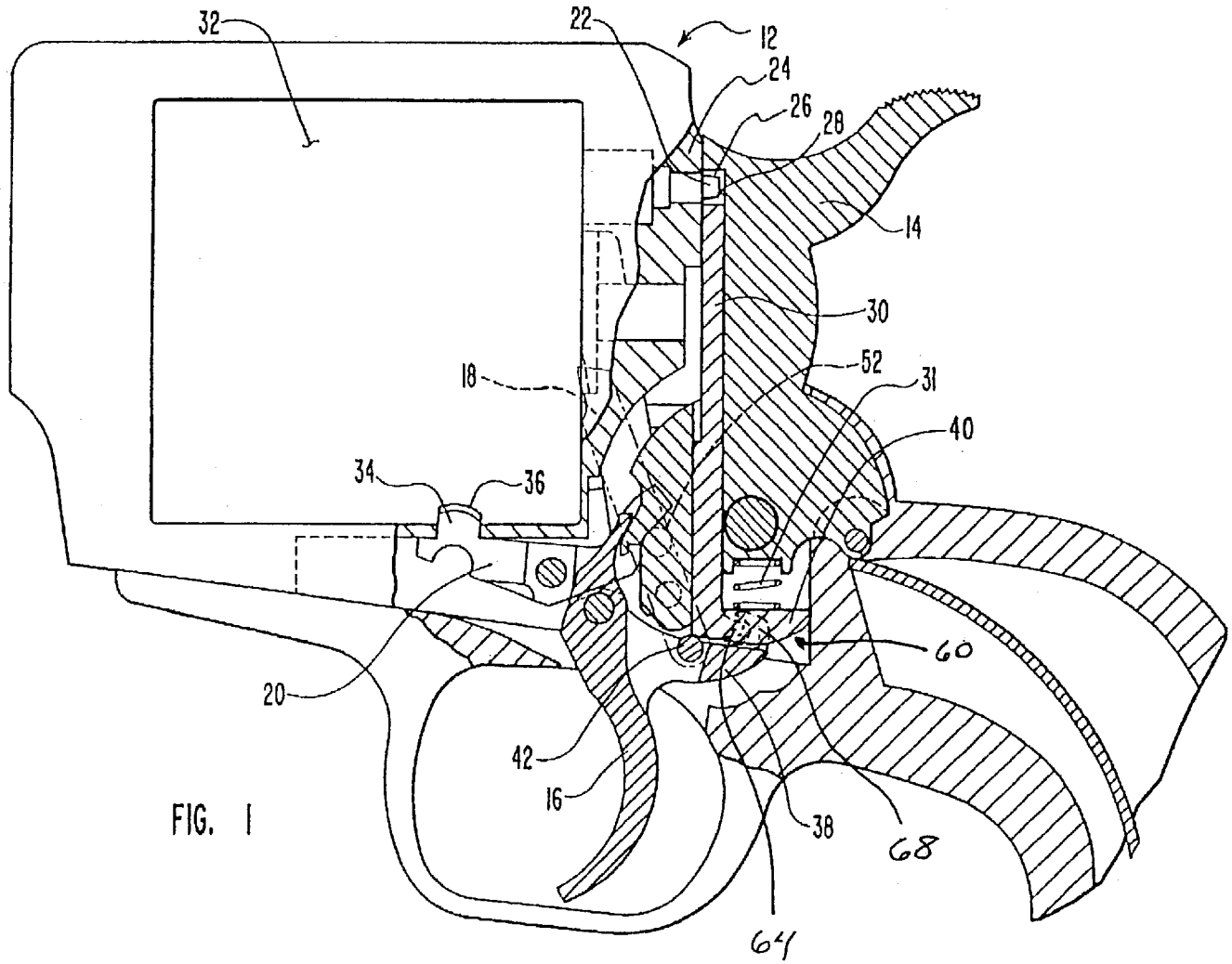
FIG. 1 illustrates a cross-sectional, elevational view of a firearm embodying the instant invention and demonstrating the relative position of the components of the action in the "hammer-down, safe" position.

Referring now to FIG. 1, an action shown generally as 12 is depicted having a hammer 14, a trigger 16, a hand 18, and a cylinder lock 20. The action in FIG. 1 is in a "hammer down, safe" position, which is typically utilized when carrying the firearm. This is called the safe position because hammer 14 is resting against the back of receiver 24 and is therefore incapable of forward movement. An elongated vertically extending recess 26 is formed within a face 28 of hammer 14. Firing pin 22 is shown disposed within that recess. As firing pin 22 is within recess and is not in contact with hammer 14, firing pin 22 is protected from inadvertent impact. Also located within recess 26 is a transfer bar 30. Transfer bar 30 slides within recess 26 between an extended position and a retracted position. Transfer bar 30 is shown juxtaposed to firing pin 22 in the retracted position in FIG. 1. When transfer bar 30 is in the retracted position, firing pin 22 cannot be impacted by hammer 14. Also, if the trigger is pulled, the transfer bar cannot move to the extended position due to interference with the firing pin.

In order for a cartridge in a chamber of the firearm to be discharged, the kinetic energy from the release of hammer 14 must be transferred through transfer bar 30 to firing pin 22. An inadvertent release of hammer 14 when transfer bar 30 is in the retracted position results in the hammer 14 impacting receiver 24 and not firing pin 22. Firing pin 22 will be prevented from being impacted by hammer 14 as the firing pin will be protected in recess 26 and transfer bar 30 will be in the retracted position.

It will be understood that the firing pin may be designed for both center fire or rim fire cartridges.

A cylinder 32 is shown locked into position by a lug 34 located on cylinder lock 20. Lug 34 is biased into position in one of several notches 36 to lock the cylinder into position. Activated by trigger 16 is a cam 38. In the depicted embodiment, the cam 38 is formed integral with the trigger, however, the only structural limitation imposed is that the trigger must activate the cam 38. Also shown is transfer bar cam 40 formed integral with transfer bar 30. In this hammer down position, the top face of cam 38 is not in contact with a transfer bar cam 40 located at the bottom of transfer bar 30. Instead, transfer bar cam 40 is supported by a means for positioning the transfer bar into the extended position and the retracted position. In an embodiment illustrated in FIG. 1, the means for positioning the transfer bar is a transfer bar carrier pin 42. Carrier pin 42 maintains the weight of the transfer bar when the trigger is being actuated.

FIG. 1 further illustrates means for facilitating the relocation or re-positioning of transfer bar 30 from an extended position, where the firearm may be discharged through contact of hammer 14 with firing pin 22, to a retracted position, where the firearm is protected from discharge as firing pin 22 is protected within recess 26. To ensure proper operation of the safety mechanism of the present invention, transfer bar 30 must be relocated to its retracted position upon the release of trigger 16 subsequent to the discharge of the firearm and when the action, and particularly hammer 14, is in its hammer down, safe position. Relocation of transfer bar 30 to a retracted position allows firing pin 22 to properly align and be protected within recess 26 as explained above. The specific function of the means for facilitating is to assist the other components of the safety mechanism in relocating transfer bar 30 to its retracted position within recess 26 upon the release of trigger 16 subsequent to discharge of the firearm. As such, the function of means for relocating is dependent upon trigger 16 and its ability to couple or engage and interact with transfer bar 30 to perform the intended function.

In the embodiment shown here, means for facilitating comprises an engagement assembly 60 capable of engaging and coupling trigger 16 with transfer bar 30. Engagement assembly 60 is designed to work in conjunction with other components to ensure correct, efficient operation of the safety mechanism of the firearm. Specifically, engagement assembly 60 itself comprises a receiving member 64, shown as a protrusion member machined out of and integrally formed with an end of transfer bar 30 proximate trigger 14; and an engagement member 68, shown as an extension member, integrally formed with cam 38 of trigger 16, and having a hook on the end thereof, wherein engagement member 68 is capable of engaging receiving member 64 as trigger 16 is de-actuated after discharge. Although engagement assembly 60 is shown having the above-described features, one ordinarily skilled in the art will recognize that many possible configurations and assemblies may be used to couple trigger 16 to transfer bar 30 to perform the function of the above-described means for facilitating the relocation of transfer bar 30 from its extended position to a retracted position. For example, receiving member 64 and engagement member 68 may be formed instead on trigger 16 and transfer bar 30, respectively, or another configuration may be used instead of a hook and protrusion. An advantageous of the safety mechanism of the present invention is that trigger 16 and transfer bar 30 may each have means for engaging and coupling the other in a releasable relationship and at a proper time in the progression and track of the action assembly. However, for the purposes of explanation and discussion herein, engagement assembly 60 is depicted.

FIG. 1 shows engagement member 68 and receiving member 64 in a coupled relationship as the action of the firearm is in a hammer down, safe position. However, as the action, and particularly hammer 14, moves intermittently from the hammer down position to a half-cocked, loading position and further through to a fully cocked and ready to fire position, engagement assembly 60, and particularly receiving member 64 and engagement member 68 release from one another, while still maintaining an engageable tracking alignment with one another through the various stages of progression and actuation and de-actuation of the action and trigger. This specific movement and tracking of engagement assembly 60 will be discussed in greater detail below.

It should be noted that the means for facilitating the relocation of transfer bar 30 may include other assembly configurations other than those specifically described herein. The specific configuration of the means for facilitating is not intended to limit its function. One ordinarily skilled in the art will recognize the several other potential configurations and/or assemblies that may be implemented and utilized to releasably couple trigger 16, or one of its connected components, to transfer bar 30 for the specific purpose of assisting transfer bar 30 to retract from its extended position.

Figure 2:
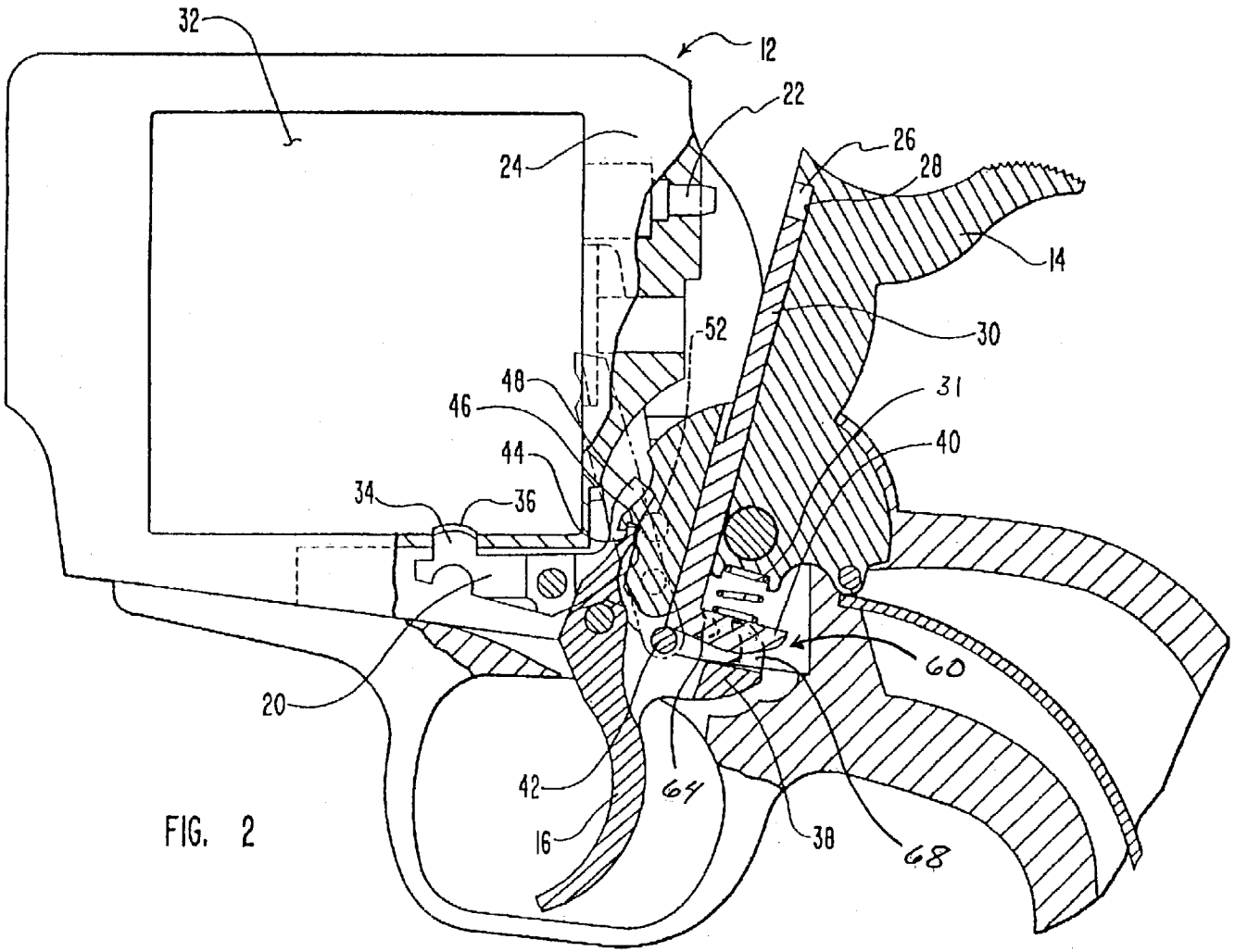
FIG. 2 illustrates an action like that shown in FIG. 1, demonstrating the relative position of the components of the action in the "half-cock, loading" position.

FIG. 2 illustrates the firearm action of FIG. 1, wherein the action is in a half-cock, loading position. In the half-cock position, the hammer 14 has been rotated away from receiver 24 to a point where a trigger sear 44 engages a sear half-cock notch 46 in hammer 14. When trigger sear 44 is engaged in sear half-cock notch 46, the trigger may not be actuated and the hammer is prevented from any forward movement. Movement of hammer 14 rotationally clockwise (FIG. 2) achieves engagement of trigger sear 44 in sear half-cock notch 46 resulting in the action being in the half-cock position. Rotation of hammer 14 also rotates plunger 52, which is partially recessed into hammer 14. The position of plunger 52 under cylinder lock 20 results in the lifting of an end 54 of cylinder lock 20 when hammer 14 is rotated. The lifting of end 54 pivots lug 34 out of notch 36 to allow cylinder 32 to freely rotate. It is in this position that the embodiment illustrated in FIG. 2 is easiest to load.

It should be clear that not all embodiments will have a half-cock or loading position on the hammer into which the trigger sear may be engaged. This position is merely utilized to demonstrate the movement of the transfer bar relative to the trigger. In this position, transfer bar 30 is upheld by carrier pin 42 and is not in contact with trigger 16. As the hammer 14 is rotated rearwardly between the safe position and the half-cock position, transfer bar cam 40 may momentarily contact trigger cam 38. It is important to note that although such contact may occur in some embodiments, one aspect of the invention is that such contact does not occur in the full-cock position, and that such contact does not occur until after the trigger has been fully actuated.

Although plunger 52 is shown elevating end 54 of cylinder lock 20, it should be appreciated that other structures may be used to elevate end 54 in conjunction with the rotation of hammer 14. The only structural limitation imposed on the elevator is that it must be able to be recessed into hammer 14 so that upon activation of the trigger, the forward rotation of the hammer will not be impeded. This can be accomplished by spring-loading the plunger so that the plunger will retract into the hammer upon impact against end 54. Plunger 52 is biasing outwardly out of hammer 14, but retracts to pass by rearward portion 48 and end 54 after trigger 16 has been actuated and hammer 14 is rotated in a forward direction. Although not illustrated, it is well known in the art that hammer 14 can be biased using several techniques, the most common of which is a spring located within the grip three. Similarly, a biasing means such as a spring 31 is utilized to bias transfer bar 30 in a downward direction. The bias supplied to transfer bar 30 must be sufficient to assist transfer bar 30 into its retracted position before an inadvertent release of hammer 14 allows contact with firing pin 22.

FIG. 2 also illustrates means for coupling transfer bar 30 to trigger 16 or trigger cam 38, comprising an engagement assembly 60. In this position engagement assembly 60 is shown in a decoupled relationship. Particularly, receiving member 64 (shown as a protrusion in an end of transfer bar 30) is shown separated and released from engagement member 68 (shown as an extension, from trigger cam 38, having a hook). In function, engagement assembly 60 releases or decouples as hammer 14 is drawn back. It is only intended that engagement assembly be coupled or engaged when hammer 14 and the action of the firearm is in the hammer down, safe position. As hammer 14 is drawn back, engagement assembly 60 disengages. Specifically, as hammer 14 is drawn back, receiving member 64 and engagement member 68 disengage and are released from one another. This separation allows transfer bar 30 to relocate or slide within recess 26 to its extended position enabling the firearm to discharge.

Although engagement assembly 60 disengages as hammer 14 is drawn and continues to be disengaged through the entire track of the action of the firearm, and particularly hammer 14, its alignment is maintained because of the subsequent interaction of transfer bar cam 40 and trigger cam 38 once the action, and particularly hammer 14, is moved out of its hammer down, safe position. Thus, as discharge occurs and hammer 14 is thrust to its hammer down, safe position, both receiving member 64 and engagement member 68 remain and are properly aligned, wherein receiving member 64 is ready to receive engagement member 68 upon release of trigger 16.

Figure 3:
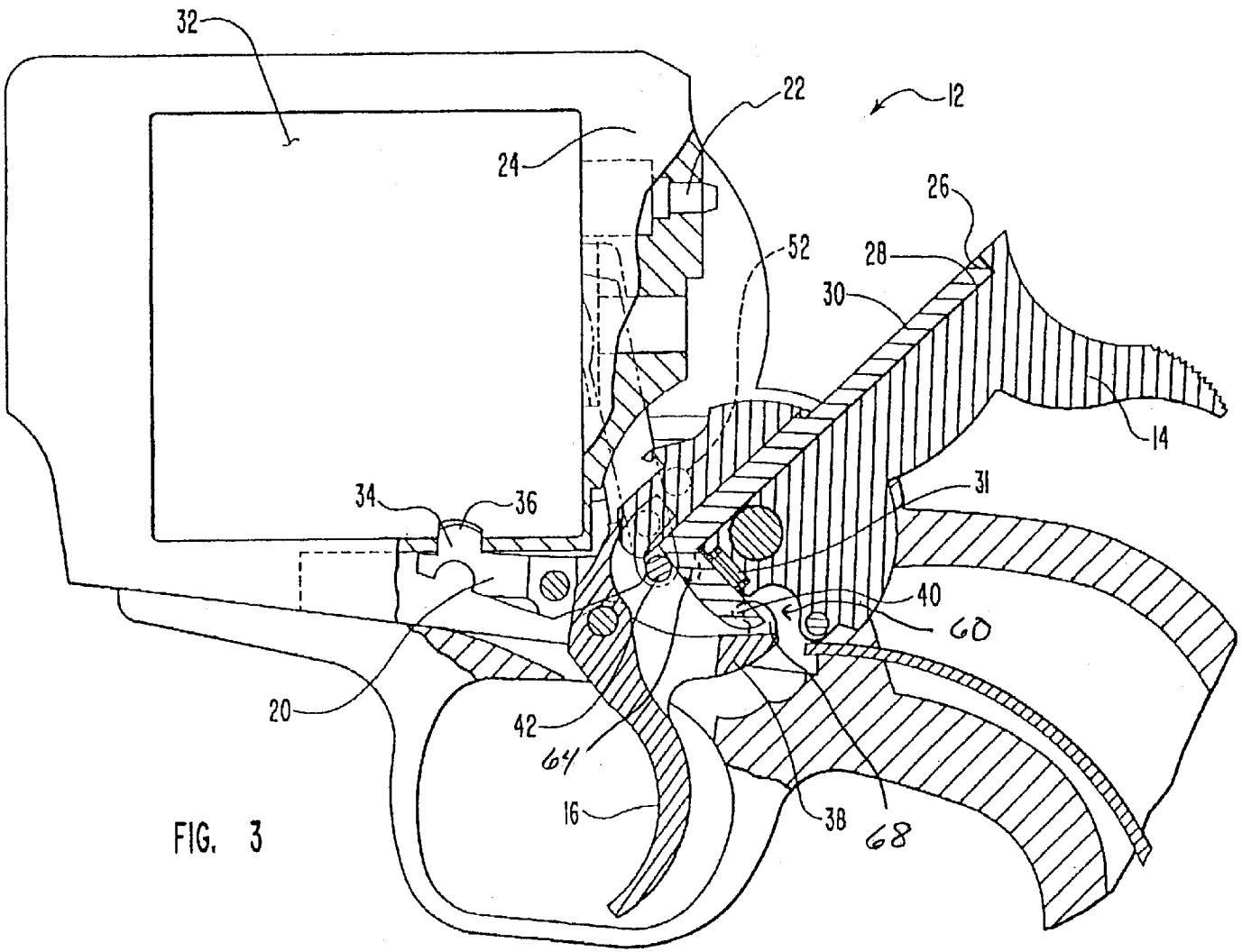
FIG. 3 illustrates a cross-sectional, elevational view of the action like that shown in FIGS. 1 and 2, demonstrating the relative position of the components in the "full-cock, ready to fire," position.

FIG. 3 depicts the action illustrated in FIGS. 1 and 2 in the "full-cock" or "ready-to-fire" position. In this position, cam 38 of trigger 16 is not in contact with transfer bar 30. Transfer bar 30 is in its extended position filling recess 26 and is interposed between firing pin 22 and hammer face 28. Transfer bar 30 is raised to and held in the extended position by the means for positioning. In this embodiment, the means for positioning is carrier pin 42, which is attached to hand 18. Rotation of the hammer to the full-cock position results in the movement of hand 18 and concomitant upward movement of carrier pin 42 and transfer bar 30 to the extended position. Inadvertent release of hammer 14 at this point would result in transfer bar 30 being biased out of the extended position at a point in the travel of hammer 14 between the full-cock and the hammer down positions. In other words, no discharge would occur. Instead, hand 18, which is attached to hammer 14 would be lowered, thereby lowering carrier pin 42. The lowering of carrier pin 42 into its retracted position would subsequently allow transfer bar 30 to drop as biasing means or spring 31 exerts a downward force upon transfer bar 30, thereby causing transfer bar 30 to retract and opening the portion of recess 26 allowing contact of hammer 14 with the rear of receiver 24 without transferring kinetic energy to firing pin 22.

During intentional firing of the firearm, however, full actuation of trigger 16 results in the pivoting of cam 38 into contact with transfer bar cam 40 and continued pressure on trigger 16 retains transfer bar 30 in the extended position despite the lowering of hand 18 and carrier pin 42. By maintaining transfer bar 30 in the extended position, the kinetic energy created by the release of hammer 14 is transferred through transfer bar 30 into firing pin 22 thereby discharging the cartridge.

The advantage to this aspect of the invention is that trigger 16 may be actuated without the weight of transfer bar 30 being placed on cam 38. The weight of transfer bar 30 is not borne by cam 38 until after trigger 16 has actuated the release of hammer 14. This results in a much lighter and smoother pull and thereby imparts more accuracy to the firearm.

Plunger 52 may be seen in phantom at a position above end 54. Rotation of hammer 14 to the full-cock position concomitantly rotates plunger 52 around end 54, thereby releasing end 54 and allowing lug 34 to be biased back into notch 36.

Engagement assembly 60 is illustrated in its fully disengaged position, wherein receiving member 64 and engagement member 68 are separated, yet still aligned for subsequent engagement. The relationship of engagement assembly 60 in this position is similar to the one described and shown in FIG. 2, but with further separation of receiving member 64 and engagement member 68.

Figure 4:
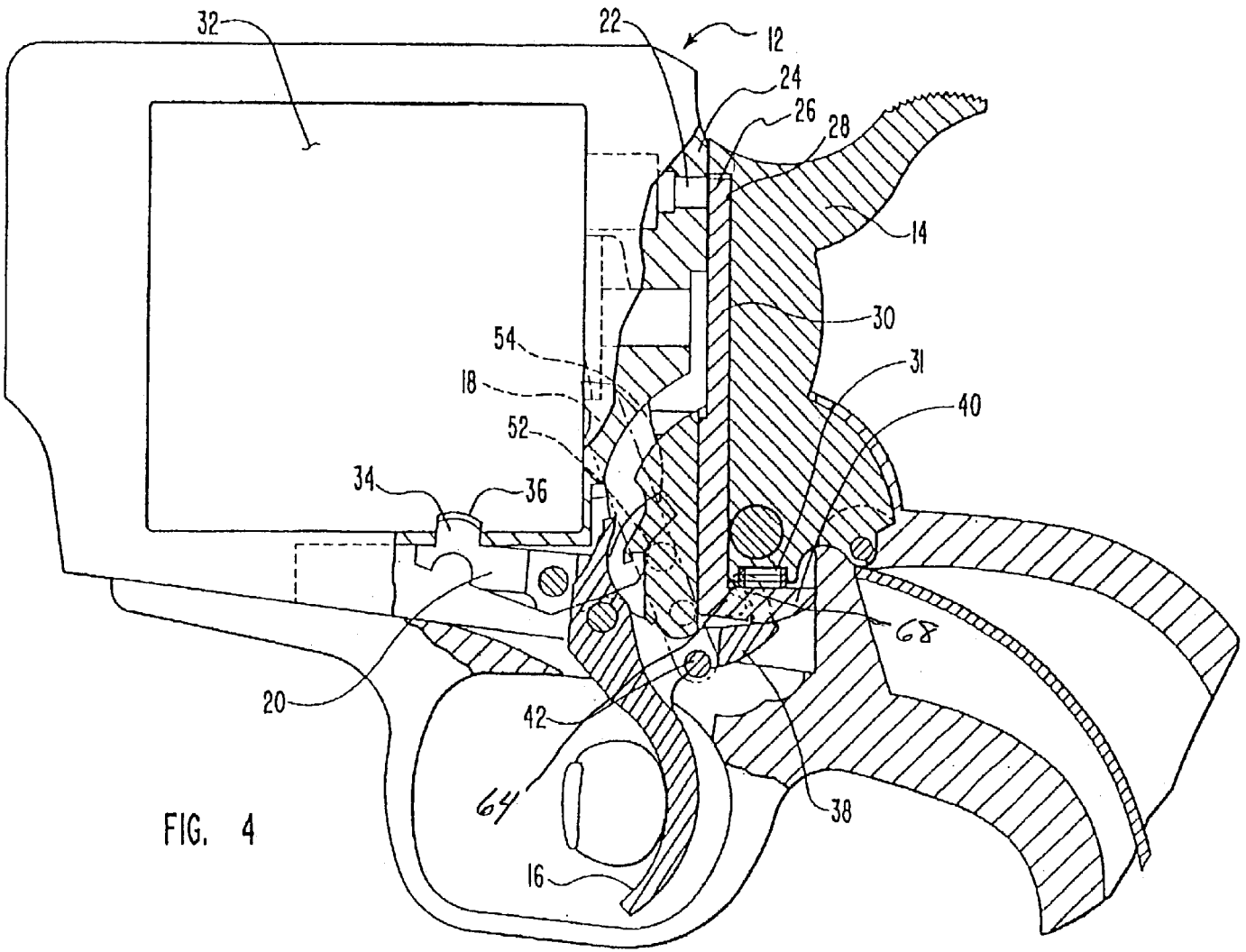
FIG. 4 illustrates an action shown like that in FIGS. 1 through 3, demonstrating the relative position of the components in the "hammer down, fired" position.

FIG. 4 depicts the action in FIGS. 1 through 3 after the trigger has been fully actuated, but before the trigger has been released. As previously discussed, if trigger 16 is released before hammer 14 and transfer bar 30 contact firing pin 22, then transfer bar 30 will be biased into the retracted position and recess 26 will be exposed into which firing pin 22 will enter. Since recess 26 is dimensioned larger than the portion of firing pin 22, which extends beyond receiver 24, no contact is made between hammer 14 and firing pin 22 when transfer bar 30 is in a retracted position. When trigger 16 is maintained in the actuated position, however, cam 38 maintains transfer bar 30 in the extended position and the kinetic energy from hammer 14 is transferred through transfer bar 30 into firing pin 22 and the cartridge within the chamber is discharged.

Upon release of the trigger, transfer bar 30 will be biased and assisted downward to once again rest on the means for positioning. Firing pin 22 will be biased outward into recess 26 and the action will be ready to be cycled once again.

FIG. 4 also illustrates the relative position of engagement assembly 60 upon actuation of trigger 16, but before trigger 16 is released. In this position, hammer 14 is in its hammer down, safe position, thus properly aligning receiving member 64 with engagement member 68. However, as trigger 16 is not yet released, engagement member 68 is merely positioned ready to engage receiving member 64. As shown, engagement member 68 is elevated above receiving member 64 due to the backward position of trigger 16. To properly facilitate the relocation of transfer bar 30 from its extended position to its retracted position, trigger 16 must be released, thus making engagement assembly 60 dependent upon trigger 16. As trigger 16 begins its release, engagement member 68 is brought into contact with and engages receiving member 64. As trigger 16 continues to be released progressing towards its resting position, engagement assembly 60, and particularly the coupling of engagement member 68 and receiving member 64, facilitates the sliding of transfer bar 30 along recess 26 into its retracted position.

Engagement assembly 60 merely facilitates the relocation of transfer bar 30 as transfer bar 30 also has biasing means 31 coupled thereto that is capable of biasing transfer bar 30 and assisting it into its retracted position. Engagement member 60 and biasing means 31 function together to retract transfer bar 30.

The engagement assembly of the present invention is advantageous in that it enables the safety mechanism of the present invention to operate in a smooth and efficient manner, as well as preventing transfer bar 30 from being intermittently trapped between firing pin 22 and hammer 14 upon discharge of the firearm and release of hammer 14 from its fully cocked position to its fully down, safe position. In addition, by utilizing an engagement assembly biasing means 31 is not required to be the sole means responsible for retracting transfer bar 30 upon discharge of the firearm. This allows biasing means 31 to be manufactured with a smaller spring tension, which helps to reduce the kick potential of trigger 16 that is experienced when trigger cam 38 and transfer bar cam 40 come in contact with one another. Reducing the kick in trigger 16 helps decrease the chance that trigger 16 will catch the half-cock position if used on a firearm equipped with such a position.

The present invention may be embodied in other specific forms without departing from its spirit of essential characteristics. The described embodiments are to be considered in all respects only al illustrative and not restrictive. The scope of the invention is, therefore, indicated by the appended claims, rather than by the foregoing description. All changes that come within the meaning and range of equivalency of the claims are to be embraced within their scope

What is claimed is:

1. A mechanism for use with a firearm having a hammer, a cartridge receiving chamber in front of said hammer, a firing pin interposed between a face of said hammer and said cartridge receiving chamber so as to strike and fire a cartridge in said chamber upon actuation by a trigger, said mechanism comprising:

a) an elongated recess formed within said face of said hammer;

b) an elongated transfer bar disposed within said recess and slidably movable therein between an extended position and a retracted position, said elongated transfer bar being interposed between said hammer and said firing pin in said extended position, said elongated transfer bar being juxtaposed to said firing pin in said retracted position, thereby exposing a portion of said recess capable of receiving said firing pin therein, thereby preventing contact with said hammer;

c) means, independent of said trigger, for positioning said transfer bar into said extended position and said retracted position;

d) a trigger cam operated upon by said trigger, said trigger cam being capable of supporting said transfer bar to maintain said transfer bar in said extended position after said trigger has been actuated; and e) means, dependent upon said trigger, for facilitating the retraction of said transfer bar from said extended position into said retracted position upon the release of said trigger subsequent to discharge of said firearm when said hammer is in a hammer down, safe position.

2. The mechanism as recited in claim 1, wherein said means for facilitating said relocation of said transfer bar comprises an engagement assembly, said engagement assembly itself comprising:

a) a receiving member; and b) an engagement member capable of releasably coupling said receiving member, wherein said receiving member and said engagement member may be positioned on either of said transfer bar and said trigger cam.

3. The mechanism as recited in claim 2, wherein said receiving member comprises a protrusion extending from said transfer bar and proximate said trigger.

4. The mechanism as recited in claim 2, wherein said engagement member is a hook extending from said trigger cam.

5. A safety mechanism for use with a firearm having a hammer, a cartridge receiving chamber in front of said hammer, a firing pin interposed between a face of said hammer and said cartridge receiving chamber so as to strike and fire a cartridge in said chamber upon actuation by a trigger, said safety mechanism comprising:

a) an elongated recess formed within said face of said hammer;

b) an elongated transfer bar disposed within said recess and slidably movable therein between an extended position and a retracted position, said elongated transfer bar being interposed between said hammer and said firing pin in said extended position, said elongated transfer bar being juxtaposed to said firing pin in said retracted position, thereby exposing a portion of said recess capable of receiving said firing pin therein, thereby preventing contact with said hammer, said transfer bar further comprising means for coupling said trigger so as to facilitate the relocation of said transfer bar from said extended position to said retracted position upon the release of said trigger subsequent discharge of said firearm;

c) means, independent of said trigger, for positioning said transfer bar into said extended position and said retracted position; and d) a trigger cam operated upon by said trigger, said trigger cam being capable of supporting said transfer bar to maintain said transfer bar in said extended position after said trigger has been actuated.

6. A safety mechanism for use with a firearm having a hammer, a cartridge receiving chamber in front of said hammer, a firing pin interposed between a face of said hammer and said cartridge receiving chamber so as to strike and fire a cartridge in said chamber upon actuation by a trigger, said safety mechanism comprising:

a) an elongated recess formed within said face of said hammer;

b) an elongated transfer bar disposed within said recess and slidably movable therein between an extended position and a retracted position, said elongated transfer bar being interposed between said hammer and said firing pin in said extended position, said elongated transfer bar being juxtaposed to said firing pin in said retracted position, thereby exposing a portion of said recess capable of receiving said firing pin therein, thereby preventing contact with said hammer;

c) means, independent of said trigger, for positioning said transfer bar into said extended position and said retracted position;

d) a trigger cam operated upon by said trigger, said trigger cam being capable of supporting said transfer bar to maintain said transfer bar in said extended position after said trigger has been actuated, said trigger cam further comprising means for coupling said transfer bar so as to facilitate the relocation of said transfer bar from said extended position to said retracted position upon the release of said trigger subsequent discharge of said firearm.

* * * * *